United States Patent [19]

Sakurayama et al.

[11] 4,437,755

[45] Mar. 20, 1984

[54] LIQUID HANDLING APPARATUS FOR AN ELECTROSTATIC COPIER

[75] Inventors: Junichi Sakurayama; Tamotsu Magome, both of Kawasaki, Japan

[73] Assignee: Canon Kabushiki Kaisha, Tokyo, Japan

[21] Appl. No.: 285,670

[22] Filed: Jul. 21, 1981

Related U.S. Application Data

[63] Continuation of Ser. No. 31,945, Apr. 20, 1979, abandoned.

[30] Foreign Application Priority Data

Apr. 28, 1978 [JP] Japan ..... 53-51834
Aug. 31, 1978 [JP] Japan ..... 53-106716

[51] Int. Cl.[3] ..... G03G 15/10; G03G 21/00

[52] U.S. Cl. ..... 355/10; 118/652; 355/15

[58] Field of Search ..... 355/3 R, 10, 15; 354/318; 118/203, 651, 652, 659, 661; 430/103, 117, 118, 119

[56] References Cited

U.S. PATENT DOCUMENTS

| | | | |
|---|---|---|---|
| 1,787,824 | 1/1931 | Jones | 354/318 X |
| 3,190,205 | 6/1965 | Baumbach | 354/318 |
| 3,667,428 | 6/1972 | Smith | 118/661 |
| 3,682,077 | 8/1972 | Kent et al. | 354/318 X |
| 3,781,107 | 12/1973 | Ruhland | 355/15 |
| 3,927,936 | 12/1975 | Komori et al. | 118/652 X |
| 3,951,542 | 4/1976 | Ito et al. | 355/15 |
| 4,010,288 | 3/1977 | Souma | 430/118 |
| 4,052,959 | 10/1977 | Hayashi et al. | 118/659 X |
| 4,154,522 | 5/1979 | Ikesue | 355/15 |

FOREIGN PATENT DOCUMENTS

| | | | |
|---|---|---|---|
| 52-40337 | 3/1977 | Japan | 355/10 |

*Primary Examiner*—Fred L. Braun
*Attorney, Agent, or Firm*—Fitzpatrick, Cella, Harper & Scinto

[57] ABSTRACT

A liquid handling method for use in an image forming apparatus wherein an electrostatic image formed on the surface of an image-carrying member is developed with a liquid developer and the thus developed image is transferred for further utilization. The method is performed with the use of liquid guide members provided at the peripheral portions of the image-carrying member, in order to guide a liquid which tends to enter the surface of the image carrying member from the peripheral portions thereof to outside the image carrying member.

5 Claims, 9 Drawing Figures

LIQUID HANDLING APPARATUS FOR AN ELECTROSTATIC COPIER

This is a continuation of application Ser. No. 31,945, filed Apr. 20, 1979 now abandoned.

BACKGROUND OF THE INVENTION

1. Field of the Invention

The present invention relates to a liquid handling method and an apparatus therefor for use in an imaging apparatus utilizing liquid development and image transfer, and capable of preventing the intrusion of unnecessary liquid into the area within the developed image before transfer is formed.

2. Description of the Prior Art

For the purpose of obtaining a visible image from an electrostatic image formed on an image carrier by means for example of an electrophotographic process, the liquid development process has been in wide use because of the tonal rendition thereof.

The surface of such image carrier developed with such liquid development process inevitably carries a certain amount of excessive liquid developer which has to be eliminated regardless whether the developed image is to be fixed on said image carrier or is to be transferred onto a transfer material.

Particularly in the field of the transfer processes in which the image obtained by liquid development is transferred onto a transfer material, there have been proposed various methods to eliminate such excessive developer in order to obtain a satisfactory transferred image.

In such liquid development process involving the image transfer, the elimination of excessive liquid developer is particularly important as an elevated amount of the excessive liquid developer, if present on the transfer material, will render the rapid fixation of the transferred image on the transfer material difficult. Also in such case, the fixation, which is usually achieved by heating, will consume an elevated amount of thermal energy for evaporating said excessive liquid developer, thus wasting the energy, resulting in a higher load to the fixing means and thereby leading to a larger space therefor.

Besides the transfer material containing an elevated amount of excessive liquid developer may not be completely dried even after passing the fixing means and be delivered to the user in a wet state, thus staining the hands of the user or other articles which may come into contact therewith.

Furthermore, the image transfer, if conducted in the presence of an elevated amount of the excessive liquid developer, will easily result in image streaking and thus is unable to maintain a satisfactory image quality. In order to prevent the foregoing drawbacks the excessive liquid developer is squeezed off from the surface of the image carrier, and such squeezing can be achieved for example by an air-knife method utilizing an air flow directed toward the surface of said image carrier as disclosed in the U.S. Pat. No. 3,741,649, by a corona squeezing method utilizing a corona discharge from a corona discharger as disclosed in the U.S. Pat. No. 3,722,994, or by a roller squeezing method utilizing a roller rotated at a determined distance from the surface of said image carrier as disclosed in the U.S. Pat. No. 3,957,016, among which the latter two are widely used in practice.

These known methods, however, are defective in that the squeezing may often not be achieved effectively and become uneven in the lateral edge portions of the surface of the image carrier. Various improvements proposed to overcome this defect has not necessarily been successful. In addition to the foregoing, the present inventors have found that a satisfactory transferred image cannot be obtained by simply squeezing off the excessive liquid developer present on the surface of the image carrier.

In fact the present inventors have found a fact that the thickness of liquid layer on the surface of the image carrier holding thereon the developed image before the image transfer is perturbed by a stray flow of the liquid developer removed in the cleaning section or overflowing from the developing section to the lateral portions of the image carrier.

The use of a cleaning liquid is currently done in commercially available apparatus for achieving an effective cleaning, and a considerable amount of the stray flow as explained above is particularly inevitable in such apparatus. Although the decrease in the amount of the cleaning liquid allows to reduce the amount of such stray flow in such case, it will result at the same time in a reduced cleaning efficiency, thus undesirably affecting the recycling of the image carrier and the image quality.

The present invention has been achieved in consideration of the foregoing drawbacks.

SUMMARY OF THE INVENTION

The object of the present invention is to provide an improved liquid handling method and the apparatus therefor for allowing to maintain a satisfactory image reproduction in an image forming apparatus utilizing a liquid development process, and more specifically to provide a liquid handling method and the apparatus therefor allowing to prevent the intrusion of unnecessary liquid onto the surface of the image carrier before the image transfer, thereby enabling to improve the quality of the transferred image.

The above-mentioned object is achieved, in the present invention, by liquid guide members provided in the proximity of or in contact with the lateral edges of an image carrier which supports an electrostatic image thereon, renders said image visible upon receipt of the liquid developer and transfer thus obtained visible image onto a transfer material, said liquid guide members being adapted to divert from said image carrier the unnecessary liquid which otherwise tends to flow onto the surface thereof. In the apparatus of the present invention there will be provided means for supporting said liquid guide members in the proximity of or in contact with the lateral edges of said image carrier.

Another object of the present invention is to provide an efficient image forming apparatus embodying the above-explained liquid handling method.

DESCRIPTION OF THE PREFERRED EMBODIMENTS

Figure 1:
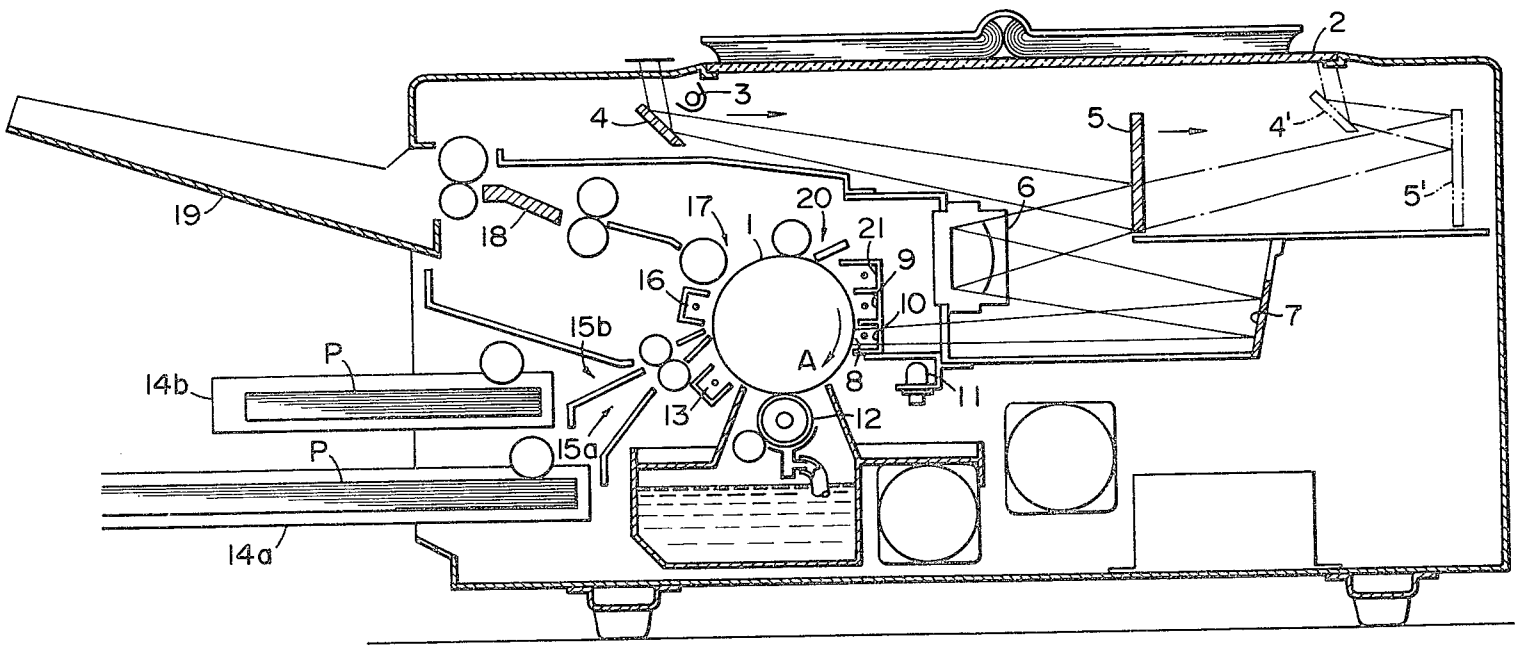
FIG. 1 is a lateral view of an electrophotographic apparatus utilizing liquid development and image transfer incorporating an apparatus embodying the present invention.

FIG. 1 shows, in a lateral view, an electrophotographic apparatus utilizing the liquid development process with image transfer and incorporating a liquid handling apparatus embodying the present invention.

A photosensitive drum 1 is provided on the surface thereof with a photosensitive member 1' essentially composed of an electroconductive layer, a photoconductive layer and an insulating layer, said photosensitive drum 1 being rotated in the direction of arrow A by means of an unrepresented drive means. An original of which image is to be formed on said photosensitive drum 1 is placed on an original supporting glass plate 2 and is illuminated with a lamp 3. A first mirror 4 is displaced integrally with said lamp 3 to scan the light reflected by said original at a speed synchronized with the rotation of said photosensitive drum 1. A second mirror 5 is displaced at a speed equal to half of that of said first mirror 4 thereby maintaining a constant optical path length to an optical lens system (in-mirror lens) 6. Thus said first and second mirrors initiate the scanning at the full-lined position and complete the scanning at the chain-lined position. The optical image formed by said scanning is guided through said in-mirror lens 6 and a fixed mirror 7, and is exposed onto the photosensitive drum 1 at an exposure station 8.

The surface of the photosensitive drum 1 is subjected in advance to a uniform electrostatic charging by means of a primary charger 9, and then to a charge elimination by an AC corona discharge from a charge eliminator 10 simultaneously with the above-mentioned image exposure. Said AC corona discharge may be replaced by a DC discharge of a polarity opposite to that of said primary charging, or by an AC corona discharge involving a bias voltage of said opposite polarity.

Successively the surface of the photosensitive drum 1 is uniformly irradiated with a flush exposure lamp 11 to obtain a positive electrostatic latent image of an elevated contrast corresponding to the optical image of the original. The electrostatic latent image thus obtained is successively developed in a liquid development station 12 positioned under said photosensitive drum 1. In the illustrated embodiment there is employed, as will be more detailedly explained in the following, a roller developing device in which the liquid developer impregnated in an absorbent layer of a developing roller is supplied onto the surface of said photosensitve drum to achieve the image development, and the excessive liquid remaining on said surface after the development is again absorbed in a portion of said absorbent layer now being separated from said surface. The surface of the photosensitive drum supporting thus developed image thereon is subjected to a post-charging by means of a post-charger 13 in order to prevent the streaking of said developed image, thus maintaining a satisfactory image quality.

After said post-charging, the developed image present on the photosensitive drum 1 is transferred onto a transfer material or paper P, which is supplied selectively from either of the paper feed cassettes 14*a*, 14*b* and guided through guide means 15*a* or 15*b* to a transfer station, wherein the image transfer is achieved by a transfer corona discharge applied by a transfer corona discharger 16 positioned behind said transfer material P.

Said transfer material P after said image transfer is separated from the photosensitive drum in a separating station 17 and advanced to a fixing station 18. After drying and image fixation by a hot plate or by heat radiation in said fixing station, the transfer material is ejected onto a paper tray 19 provided outside the apparatus.

On the other hand the liquid developer remaining on the surface of the photosensitive drum after said image transfer is removed by cleaning means provided on top of the drum 1, whereby said drum is prepared for the succeeding image forming cycle.

A charger 21 is provided between said cleaning means and the primary charger in order to eliminate the charge eventually remaining on the photosensitive drum 1, and another flush exposure lamp may be employed in combination with said charger.

Figure 2:
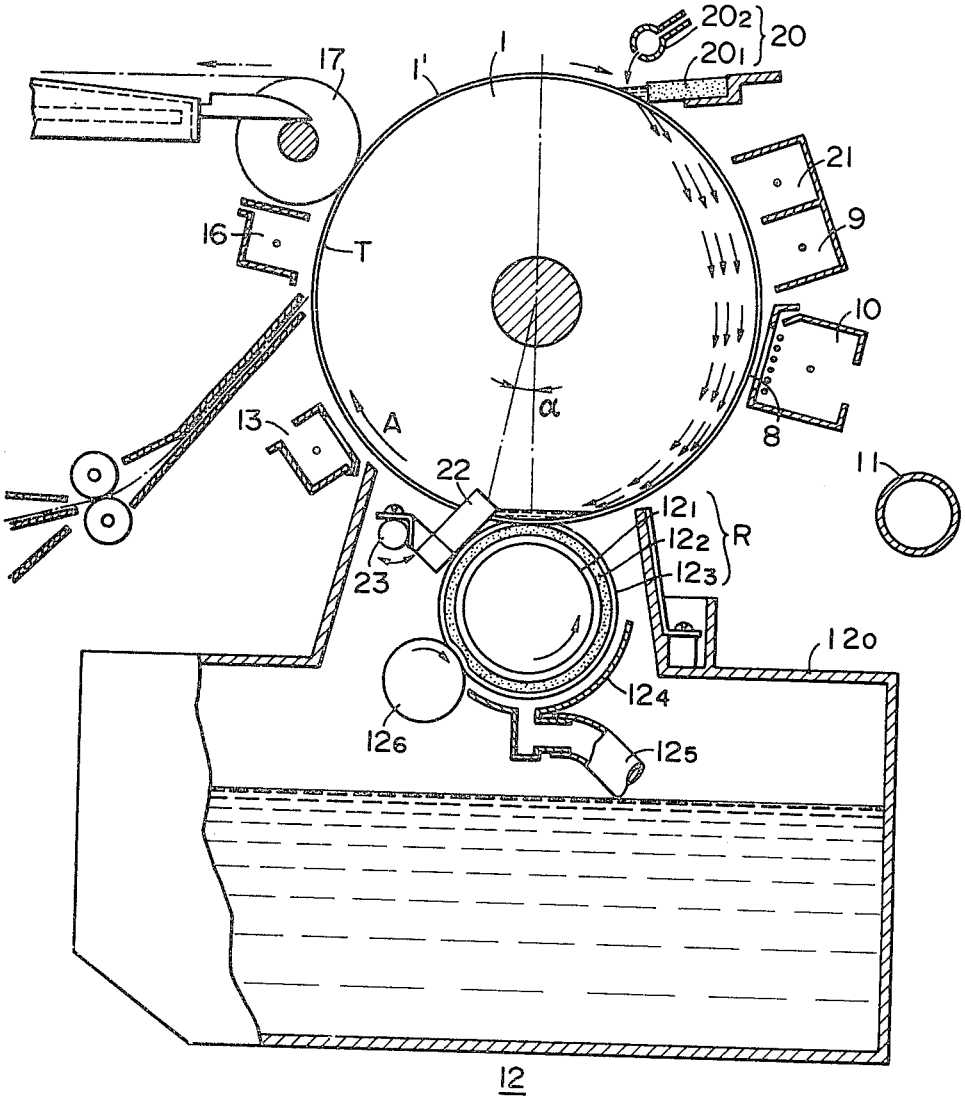
FIG. 2 is an enlarged partial view around the photosensitive drum in the apparatus shown in FIG. 1.

FIG. 2 is an enlarged partial view of the peripheral portion of the photosensitive drum shown in FIG. 1, and along said periphery there are provided latent image forming means, liquid development means, transfer means and cleaning means respective at the descending side, bottom side, ascending side and top side.

The cleaning means positioned approximately on top of said photosensitive drum is composed, in the illustrated example, of an elastic cleaning blade $20_1$, eventually in combination with a liquid supply nozzle $20_2$ provided in the vicinity thereof for supplying a cleaning liquid (composed of a carrier liquid or the liquid developer itself) to improve the cleaning efficiency.

Said cleaning means functions to expel the remaining liquid developer and eventually the cleaning liquid toward the lateral edges of the photosensitive drum, the liquid thus expelled flowing down along the lateral faces of the photosensitive drum and being recovered in the developing means 12 positioned under said drum 1.

Conventionally, such expelled liquid inevitably enters, at the dripping from the bottom of the photosensitive drum 1, the surface thereof utilized for image formation.

In the apparatus of the present embodiment, however, there are provided two liquid guide members 22 (one of which is not shown on the drawing) on both lateral sides and approximately at the bottom of the photosensitive drum to avoid such intrusion of the expelled liquid into the surface area of said drum, wherein at least either one of said guide members 22 is pivotably supported by an axis 23 whereby said guide members are maintained in the proximity of or in contact with the lateral faces of the photosensitive drum 1 and are still rendered displaceable so as not to hinder the removal of said drum.

Thus the expelled liquid having reached the bottom of the photosensitive drum enters in contact with said liquid guide members positioned as explained above and is guided downwards along said members because of the surface tension of the liquid in combination with the gravity thereof and against the possible surface tension tending to attract the liquid toward the surface of the photosensitive drum, whereby the liquid intrusion onto said surface can be prevented.

In this manner the expelled liquid flows down along said liquid guide members 22, without entering the surface of the photosensitive drum during and/or after the image development.

Said liquid guide members 22 may be provided with a circular or polygonal section in order to facilitate the guiding of the liquid.

Also in order to further facilitates said guiding said liquid guide members are preferably composed of or coated with a material easily wettable with the liquid, for example a metal or a glass.

Also it is preferable to render the lateral edges, particularly lateral edge portions of the surface, of the photosensitive drum not easily wettable by said liquid.

Particularly in case of the photosensitive member as explained in the foregoing, the surface insulating layer composed of an organic polymer compound less wettable by the liquid in comparison with inorganic metals such as selenium functions to prevent the intrusion of the expelled liquid in cooperation with the above-explained liquid guide members.

Said liquid guide members are to be provided in a position, with respect to the photosensitive drum, allowing satisfactory liquid guiding. A preferred position for said liquid guide members is at a point where the liquid will otherwise drip off from the lateral edges of the photosensitive drum, said position being generally located, at the ascending side of the drum, at the direction of an angle $\alpha$ from the vertical line passing through the center of the drum.

Such an angle $\alpha$ appears from the following reason. The expelled liquid flows down along the lateral faces of the photosensitive drum from approximately top thereof, and, passing through the lowermost point of the drum, is brought upwards again by a certain distance on the ascending side thereof by the drum rotation. The liquid thus brought upwards eventually starts to flow in reverse direction, along the drum periphery and collides with the succeeding forward flow, thus forming a liquid pool by the equilibrium of the ascending forward flow and the descending reverse flow, from which position the liquid drips off from the photosensitive drum.

In this manner the expelled liquid drips off from the photosensitive drum at the position of such liquid pool which is thus located at the ascending side of said drum.

Said liquid dripping position at the ascending side of the drum depends upon the rotating speed of the drum, the material constituting the lateral faces thereof, liquid viscosity etc., but remains substantially constant in practical copiers utilizing the liquid development since the rotating speed of the drum and the liquid developer used are constant.

For example in case a photosensitive drum of a diameter of 136 mm with aluminum side faces rotated at a speed of 220 mm/sec in combination with Isoper H as the liquid developer, the liquid guide member is most preferably at an angle $\alpha$ within a range of ca. 15°–20°. Also said members are composed of metal rods of a circular section with a diameter of 2–5 mm. the liquid can be satisfactorily guided if they are distanced by 0–1 mm from the drum.

The liquid development means detailedly shown in FIG. 2 is rendered capable of fully exploiting the developing performance thereof in combination with the above-mentioned liquid guide members.

A developing roller R is composed of an electroconductive core roller $\mathbf{12_1}$ surrounded by an absorbent sponge layer $\mathbf{12_2}$ which is further covered on the periphery thereof with a mesh screen $\mathbf{12_3}$.

Under said developing roller R there is provided a developer supply tray $\mathbf{12_4}$ into which the liquid developer is supplied from a developer reservoir $\mathbf{12_0}$ constituting the casing of the developing means through a supply pipe $\mathbf{12_5}$ by means of an unrepresented supply pump. A refresh roller $\mathbf{12_6}$ is at the entrance end of said developer supply tray $\mathbf{12_4}$ with respect to the rotating direction of the developing roller R and is maintained in pressure contact therewith to squeeze of the liquid contained in the sponge layer thereof. The space enclosed by said refresh roller $\mathbf{12_6}$, developer supply tray $\mathbf{12_4}$ and developing roller R is filled with the liquid developer supplied thereinto, so that the sponge of the developing roller R released from said refresh roller $\mathbf{12_6}$ becomes sufficiently impregnated with said liquid developer. The roller surface thus holding the liquid developer up to the level of the surfacial mesh screen then reaches the surface of the photosensitive drum 1 and enters into contact therewith whereby the liquid developer impregnated in the developing roller R being utilized for developing the electrostatic latent image on the surface of said photosensitive drum.

Then upon release of the developing roller R from the contact position, the sponge layer is decompressed to absorb the excessive portion of the liquid developer, particularly the excessive carrier liquid thereby achieving a squeezing effect.

The developing roller R thus impregnated with such excessive liquid then reaches the contacting position with the aforementioned refresh roller $\mathbf{12_6}$ where the developing roller R is squeezed and prepared for the impregnation of fresh liquid developer. On the other hand the squeezed liquid developer is collected in said reservoir $\mathbf{12_0}$ in which the concentration is generally controlled to enable the recycling of the recovered liquid developer.

As the result of such development there will be formed, on the surface of the photosensitive drum, a sharp toner image and a thin liquid layer covering said toner image and required for the image transfer.

The aforementioned intrusion of the expelled liquid onto the surface of the photosensitive drum in such state will result in a significant local increase of the liquid amount, leading not only to locally unbalanced image transfer and wetting of peripheral areas but also to a perturbed image formation. By the use of the above-mentioned liquid guide members, however, it is rendered possible to avoid the foregoing drawbacks.

Figure 3:
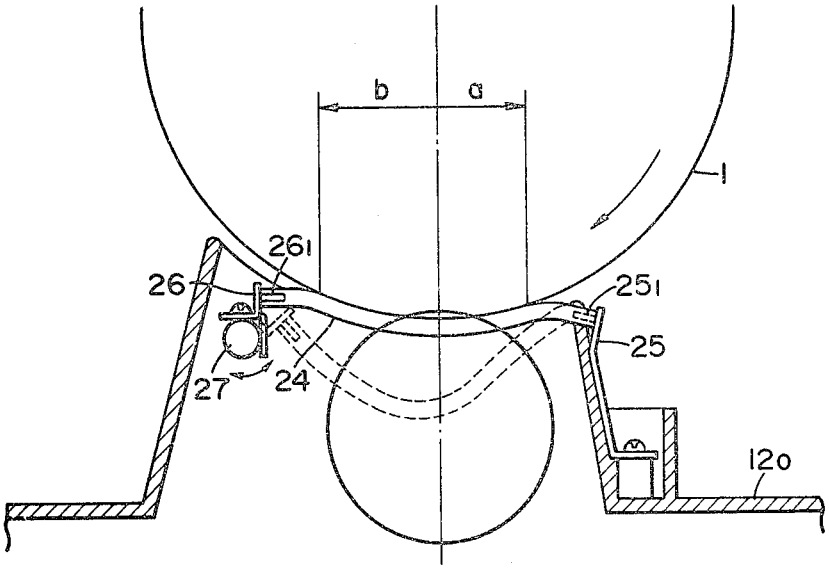
FIG. 3 is a lateral view of a modified apparatus embodying the present invention.

FIG. 3 shows a modification of the present invention in a lateral view, wherein the liquid guide members 24 are composed of an elastic rod material such as a highly elastic synthetic rubber or a coil spring, positioned along the periphery of the photosensitive drum. Said liquid guide members 24 are supported at one ends thereof by a support member 25 fixed to the casing $\mathbf{12_0}$ of the developing means while at the other ends by a support member 26 amounted on a rotatable axis 27. Said support members 25, 26 are respectively provided with pins $\mathbf{25_1}$, $\mathbf{26_1}$ respectively engaging with the end portions of said liquid guide members, and are positioned in such a manner that said engaging pins $\mathbf{25_1}$, $\mathbf{26_1}$ are directed more inwardly or closer toward the center of the photosensitive drum than the tengential direction thereto, thereby enabling the liquid guide members 24 to have an extended contact area with the periphery of the photosensitive drum.

The above-explained extended contact area of the liquid guide members 24 with the lower periphery of the photosensitive drum is particularly effective for a variation in the rotating speed thereof, such as the drive start period or drive terminating period, since the guide members are capable of satisfactorily guiding the expelled liquid without intrusion thereof onto the surface of the photosensitive drum even when the liquid dripping position is changed due to such change in the rotating speed of the drum. Such form of liquid guide members is particularly preferable when the supply of cleaning liquid is initiated approximately at the same time with the start of drum drive, or when the supply of cleaning liquid is continued after the completion of the copying operation until the photosensitive drum becomes completely stopped, since the amount of liquid arriving at thus varying liquid dripping position becomes larger in such cases. For example for a photosensitive drum with a diameter of 136 mm and with a peripheral speed of 220 mm/sec, the contact lengths a and b respectively at the right and left-hand side of the vertical line passing through the center of the drum are preferably not less than 20 and 25 mm.

The broken lines in FIG. 3 shows the positions of the liquid guide members 24 when the support member 26 is pivoted, whereby said guide members 24 are completely separated from the periphery of the drum 1 so as to allow free replacement of the photosensitive drum 1 or the developing means.

It will naturally be understood that the same purpose can be achieved also by rendering the other support member 25 or the both support members 25, 26 pivotable.

The liquid guide members thus maintained in contact in a bent state as explained above with the periphery of the photosensitive drum are preferably composed of a material not showing plastic deformation even after repeated bendings and not causing damages on the peripheral surface of said drum, the examples of such material being already mentioned in the foregoing.

Also it is naturally possible to mold said liquid guide members into a form corresponding to the peripheral form of the photosensitive drum.

Figure 4:
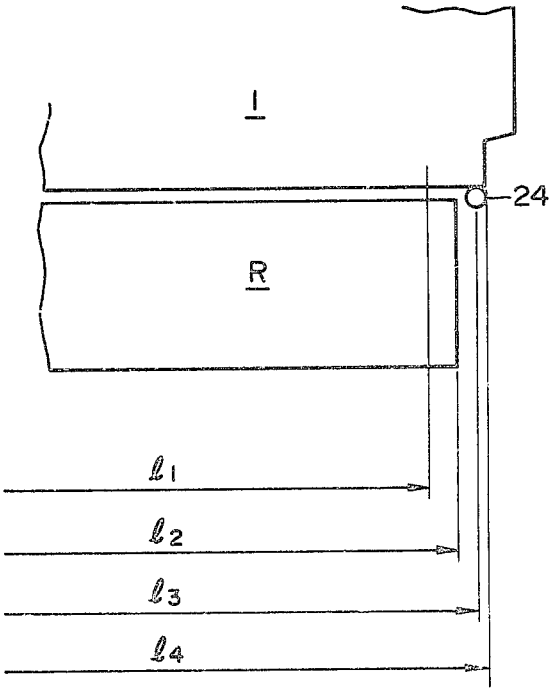
FIG. 4 is a partial cross-sectional view showing the arrangement of the photosensitive drum with respect to the apparatus shown in FIG. 3.

FIG. 4 shows, in partial cross-sectional view, the arrangement in the axial directon of the photosensitive drum 1, developing roller R and liquid guide member 24 in the present embodiment.

In response to the effective image width l1 on the photosensitive drum 1 the developing roller R is provided with a width l2 involving a certain lateral margin provided in order to avoid the eventual effect of the edge portions of the developing roller R on the image.

In the similar manner the photosensitive drum 1 is provided with a width l4 marginally larger than the above-mentioned image width l1, the margin being provided to avoid the effect of the lateral edge portions to the image. Such effect, however, can be satisfactorily avoided if the liquid guide members are positioned (l3) inside the lateral edges of the drum. Therefore, the width of the photosensitive drum need not be excessively larger than the effective image width, and this fact will significantly contribute to he compactization of the entire apparatus.

Figure 5:
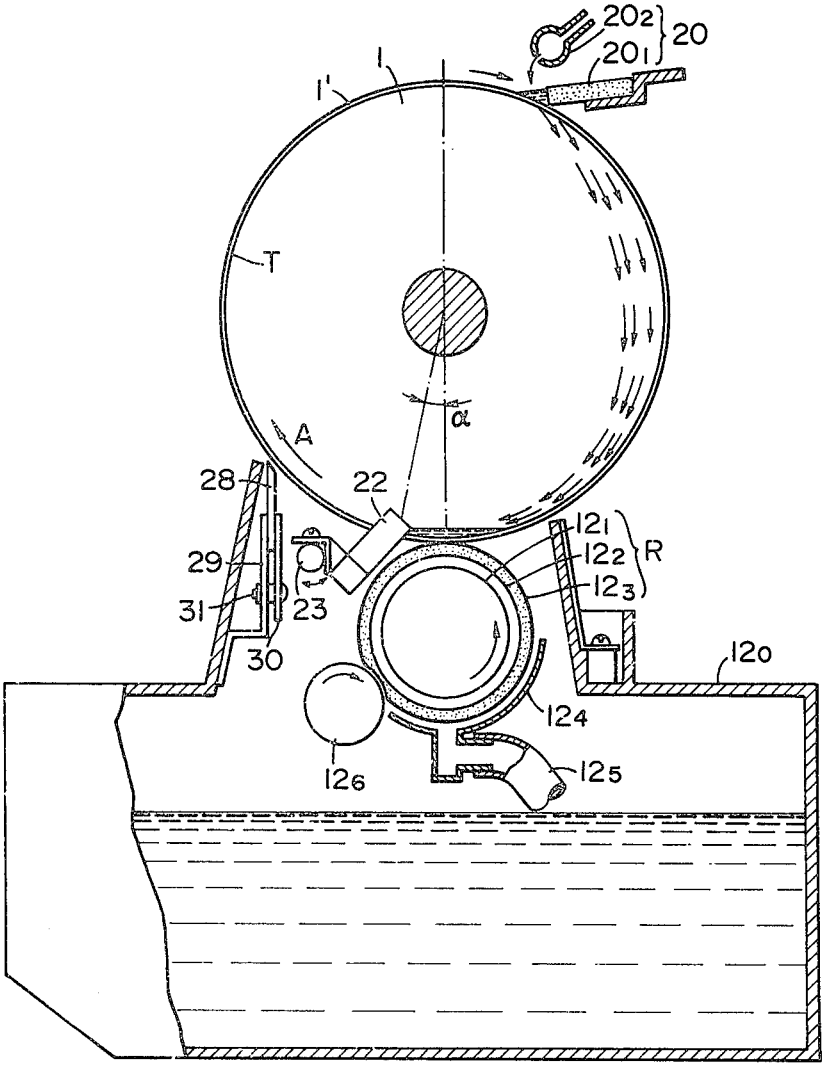
FIG. 5 is a lateral view of another modified apparatus embodying the present invention.

FIG. 5 shows another modification of the present invention in a lateral view, wherein there are provided, in addition to the liquid guide members 22 as shown in FIG. 2, scrapers 28 maintained in contact with the lateral edge portions of the surface of the photosensitive drum with which the developing roller R is not in contact. Each scrapper 28 is supported by a screw 31 between a bracket 29 fixed on the casing of the developing means and a pressure plate 30, and functions to prevent the eventual increase in the liquid thickness resulting from lateral liquid seeping from the developing roller R on the lateral edge portion of the surface of the photosensitive drum, thereby avoiding the presence of a wet edge portion in the transfer position. Also in case of using a separating belt for separating the transfer material from the photosensitive drum, it is rendered possible to prevent the error in separation resulting from excessive wetting or the stain formation on said separating belt.

Figure 6:
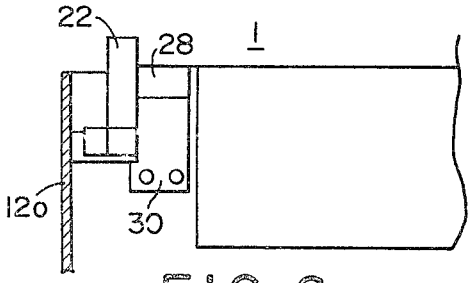
FIG. 6 is a partial view thereof in the axial direction of the photosensitive drum.

FIG. 6 shows, in a partial view, the arrangement of said scraper in the axial direction.

Said scraper is preferably made of a flexible and anti-abrasive material, for example a Myler sheet.

Figure 7:
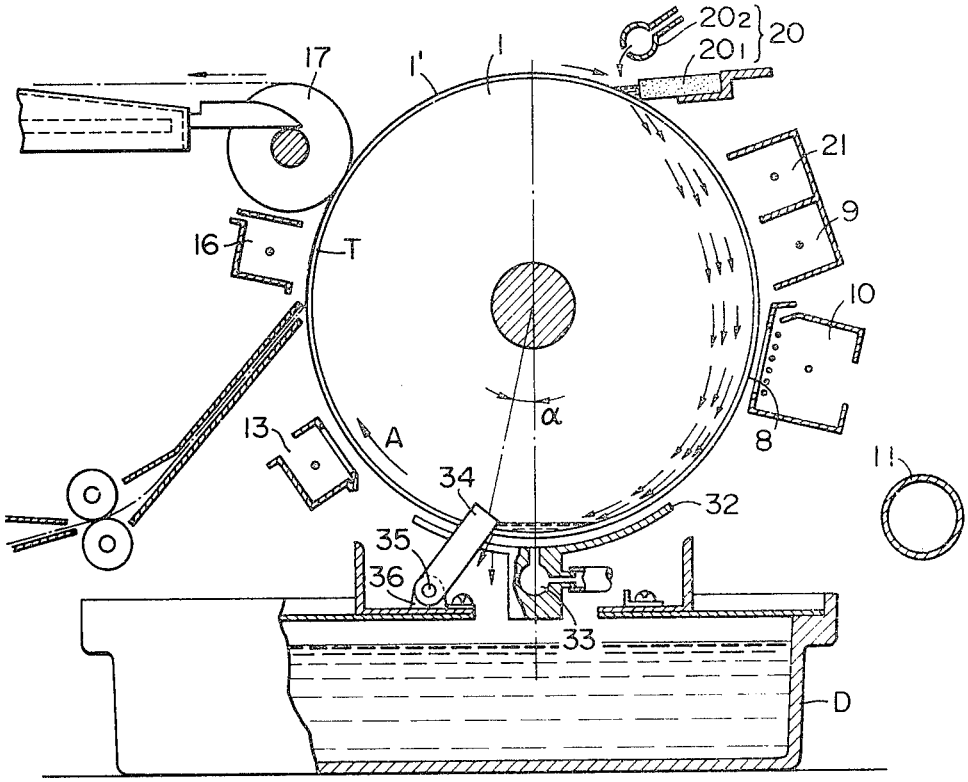
FIG. 7 is a lateral view of still another modified apparatus embodying the present invention.

FIG. 7 shows a still another embodiment of the present invention wherein the developing station of the developing roller type shown in FIG. 1 is replaced by a station D employing a developing tray, said device D being provided with a concave developing tray 32 substantially concentric with the photosensitive drum 1. The liquid developer is supplied by an unrepresented pump into said developing tray 32 through a fountain slit 33 provided approximately in the center thereof. In this manner the liquid developer is filled in said developing tray, thus contacting the surface of the photosensitive drum to conduct the image development, and then overflows from the brim of the developing tray into a liquid reservoir of the developing station D for reuse.

Under the photosensitive drum 1 and on both lateral faces thereof there are provided liquid guide members 34 (the one on the other side not shown) at least one of which is pivotably supported by an axis 35 of a support member 36 provided on the developing station D, in such a manner that said guide members 34 are normally maintained in the proximity of or in contact with the lateral faces of said photosensitive drum 1 but rendered retractable from such position so as not to hinder the replacement of the photosensitive drum as already explained in connection with FIG. 2. In this manner, as explained in the foregoing, it is rendered possible to prevent the intrusion of unnecessary liquid onto the surface of the photosensitive drum 1.

Figure 8:
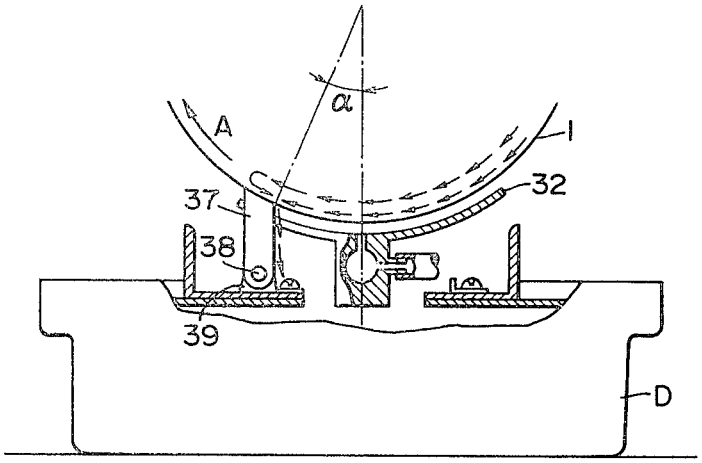
FIGS. 8 and 9 are partial lateral views of still other modifications of the apparatus embodying the present invention.

FIG. 8 shows, in a partial lateral view, still another modification of the present invention, wherein the liquid guide members shown in FIG. 7 are replaced by liquid guide member 37 maintained in the proximity of or in contact with the peripheral surface of the photosensitive drum, said guide members 37 being similarly supported pivotably by an axis 38 on a bearing 39 provided on the developing station D.

In the present embodiment where the liquid guide members are located on the surface of the photosensitive drum, it is particularly effective to arrange said member in such a manner not to disturb the liquid developer present on the surface of the photosensitive drum. This can be achieved for example by rendering the outside surface of the liquid guide members 37 easily wettable by the liquid developer and the inside surface of the liquid guide members facing the image forming area on the surface of the photosensitive drum hardly wettable by the liquid developer. By such arrangement it is possible to effectively present the intrusion of the liquid from the lateral faces to the peripheral surface of the photosensitive drum.

It is also possible to prevent the loss of the liquid developer uniformly supplied onto the surface of the photosensitive drum, thereby maintaining the uniform liquid layer thickness necessary for the image transfer.

Figure 9:
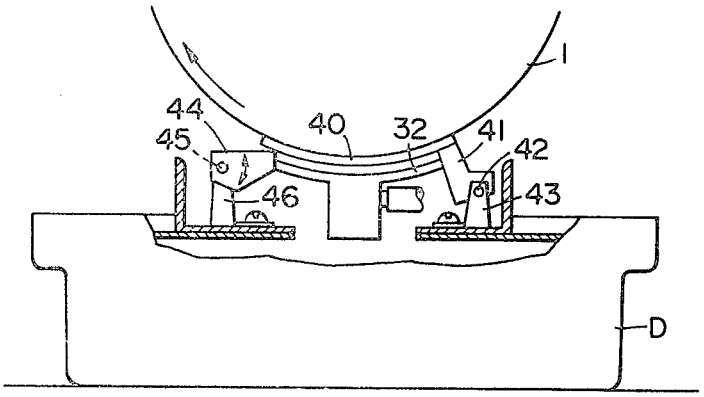

FIG. 9 shows still another modification in a partial lateral view, wherein arch-shaped liquid guide members 40 of a form approximately corresponding to that of the periphery of the photosensitive drum 1 are position in the proximity of or in contact with the lateral faces thereof. Each of said liquid guide members 40 is provided on one end thereof with an arm 41 whereby said member is pivotably supported about an axis 42 on a support arm 43 provided on the developing station D, and at the other end of said guide member opposite to said arm 41 there are provided positioning members 44 vertically displaceably engaging with said liquid guide members 40, said positioning members 44 being also pivotably supported about an axis 45 on support arms 46 fixedly provided on said developing station D. In this embodiment the liquid guide members 40 can be maintained in the proximity of or in contact with the lateral faces of the photosensitive drum by means of said positioning members 44, and are preferably maintained, in practice, at a distance not exceeding 0.5 mm from said lateral faces.

As already explained in connection with FIG. 3, this embodiment is particularly effective for the change in the rotating speed of the photosensitive drum since the liquid guide members 40 are present over an extended distance along the periphery under the photosensitive drum.

Furthermore the liquid guide members of the present embodiment may also be provided in contact with the peripheral surface of the photosensitive drum as already shown in FIG. 3 or 8.

As detailedly explained in the foregoing, the present invention enables to effectively prevent the stray flow of the unnecessary liquid for example expelled by cleaning into the image-carrying surface which is repeatedly used for liquid development and image transfer, thereby allowing to maintain the high quality of the image formed on said image-carrying surface.

What is claimed is:

1. An image forming apparatus comprising:

a rotatably supported drum-shaped image-carrying member having a circumferential surface on which a latent image is formed and a generally continuous lateral end surface extending generally perpendicularly to the rotational axis of said image-carrying member and bounded only by an extreme of said circumferential surface, said rotational axis extending generally horizontally, means for forming the latent image on the circumferential surface, said latent image forming means being located adjacent said image-carrying member in a region wherein said circumferential surface moves downwardly, means for developing the latent image at a developing station with a developing liquid, said developing means being located below said rotation axis of said image-carrying member, means for transferring the developed image onto a transfer material, said transferring means being located adjacent said image-carrying member in a region wherein said circumferential surface moves upwardly, means, located above said rotational axis in the region of the uppermost portion of said circumferential surface of said image-carrying member, for cleaning the circumferential surface to remove excess developing liquid, for directing the excess developing liquid toward said extreme of said circumferential surface, and for discharging the excess developing liquid removed from said member onto said lateral end surface to cause the excess developing liquid to travel downwardly on said lateral end surface during rotation of said image-carrying member under the influence of gravity, and liquid guide means including a rod-like member disposed in contact with or in close proximity to said image-carrying member in the region of a portion of said circumferential surface at said extreme thereof and of said lateral end surface bounded by said extreme, said rod-like member extending in the direction of movement of said image-carrying member in the region of said developing means and guiding the excess liquid away from said lateral end surface of said image-carrying member at a position adjacent said developing means, thereby preventing the excess liquid from contacting the circumferential surface of said image-carrying member downstream of the developing station with respect to the movement direction of said image-carrying member.

2. An image forming apparatus comprising:

a rotatably supported drum-shaped image-carrying member having a circumferential photosensitive surface on which a latent image is formed and a generally continuous lateral end surface extending generally perpendicularly to the rotational axis of said image-carrying member and bounded only by an extreme of said circumferential surface, said rotational axis extending generally horizontally, means for forming the latent image on the circumferential surface, said latent image forming means being located adjacent said image-carrying member in a region wherein said circumferential surface moves downwardly, means for developing the latent image at a developing station with developing liquid, said developing means being located below said rotational axis of said image-carrying member, means for transferring the developed image onto a transfer material, said transferring means being located adjacent said image-carrying member in a region wherein said circumferential surface moves upwardly, a cleaning blade located above said rotational axis in the region of the uppermost portion of said circumferential surface of said image-carrying member, for cleaning the circumferential surface to remove excess developing liquid, for directing the excess developing liquid toward said extreme of said circumferential surface, and for discharging the excess developing liquid removed from said member onto said lateral end surface to cause the excess developing liquid to travel downwardly on said lateral end surface during rotation of said image-carrying member under the influence of gravity, a liquid pool being formed on said lateral end surface at its lowermost region by the downwardly traveling liquid discharged by said cleaning blade, liquid in the liquid pool tending to be carried upwardly in the region where said lateral end surface moves upwardly by rotation of said image-carrying member but returning to the liquid pool under the influence of gravity, the location at which liquid begins to return to the liquid pool as aforesaid defining an ascending limit of the liquid pool, and liquid guide means provided in contact with or in close proximity to said lateral end surface in the region of the ascending limit of the liquid pool for guiding the excess liquid away from said lateral end surface of said image-carrying member at a position adjacent said developing means and adjacent said image-carrying member, thereby preventing the excess liquid from contacting said circumferential surface of said image-carrying member downstream of the developing station, with respect to movement direction of said image-carrying member.

3. An apparatus according to claim 2, wherein said guiding means has a rod-like member.

4. An apparatus according to claim 1, wherein said guiding means has a resilient, rod-like member.

5. An apparatus according to claims 1 or 2, wherein said liquid guide means is separable from said image-carrying member.

* * * * *

UNITED STATES PATENT AND TRADEMARK OFFICE

CERTIFICATE OF CORRECTION

PATENT NO. : 4,437,755

DATED : March 20, 1984

INVENTOR(S) : JUNICHI SAKURAYAMA, ET AL.

It is certified that error appears in the above-identified patent and that said Letters Patent is hereby corrected as shown below:

Col. 1, line 25, after "regardless" insert --of--;

line 45, between "Besides" and "the" insert -- , --;

line 55, change "is" to --will be--.

Col. 2, line 5, change "has" to --have--.

Col. 4, line 32, change "respective" to --respectively--.

Col. 5, line 11, change "facilitates" to --facilitate--;

line 36, between "approximately" and "top" insert --the--;

line 64, change "mm." to --mm--.

Col. 6, line 15, after "squeeze" delete "of";

line 26, change "being" to --is--;

line 60, change "ends" to --end--;

line 62, change "ends" to --end--;

line 63, change "amounted" to --mounted--.

Col. 7, line 1, change "tengential" to --tangential--;

UNITED STATES PATENT AND TRADEMARK OFFICE

CERTIFICATE OF CORRECTION

PATENT NO. : 4,437,755

DATED : March 20, 1984

INVENTOR(S) : JUNICHI SAKURAYAMA, ET AL.

It is certified that error appears in the above-identified patent and that said Letters Patent is hereby corrected as shown below:

Col. 7, line 28, change "shows" to --show--;

line 36, delete "the";

line 62, change "to" to --on--;

line 67, change "he" to --the--.

Col. 8, line 7, change "scrapper" to --scraper--;

line 18, delete "the";

line 23, change "Myler" to --Mylar--;

line 24, after "shows" delete --a--;

line 56, change "member" to --members--.

Col. 9, line 4, change "present" to --prevent--;

line 14, change "position" to --positioned--.

Signed and Sealed this

*Twenty-first* Day of *August 1984*

[SEAL]

*Attest:*

GERALD J. MOSSINGHOFF

*Attesting Officer*

*Commissioner of Patents and Trademarks*